US005383552A

United States Patent [19]

Dikowitz

[11] Patent Number: 5,383,552

[45] Date of Patent: Jan. 24, 1995

[54] WATCH BOX

[75] Inventor: Jerome N. Dikowitz, Plainview, N.Y.

[73] Assignee: E. Gluck Corporation, Long Island City, N.Y.

[21] Appl. No.: 190,424

[22] Filed: Feb. 2, 1994

[51] Int. Cl.[6] ..... B65D 85/40

[52] U.S. Cl. ..... 206/6.1; 29/428; 40/312; 40/649; 206/301; 206/459.1

[58] Field of Search ..... 29/428; 40/312, 313, 40/649, 653, 654; 206/6.1, 18, 45.14, 45.18, 45.19, 301, 459.5, 459.1, 566

[56] References Cited

U.S. PATENT DOCUMENTS

| | | | |
|---|---|---|---|
| 4,034,849 | 7/1977 | Zakrajsek | 206/566 |
| 4,082,183 | 4/1978 | Sturm | 206/566 |
| 4,216,858 | 8/1980 | Beauchamp | 206/45.15 |
| 4,243,340 | 1/1981 | MacGregor | 40/649 |
| 4,799,588 | 1/1989 | Trisl | 206/301 |
| 4,830,181 | 5/1989 | Hartman | 206/45.19 |
| 5,181,608 | 1/1993 | Herzog | 206/301 |

*Primary Examiner*—Jimmy G. Foster
*Attorney, Agent, or Firm*—Douglas P. Dreyer

[57] ABSTRACT

A modular watch box having a base with a watch holder disposed thereon is provided. The base also includes a feature ticket plate that is selectively removable from the base. A price tab ticket is also selectively insertible into a groove formed in the base. The base is releasably coupleable to a back panel by a snap-fit closure, and a front cover frictionally engages the base and back panel to obtain a secure closure. The front cover includes a cut-out portion and the back panel includes a slit in alignment with the groove in the base in order to allow a customized price tab ticket to be inserted into the box even when the box is close. Thus, each customer (retail supplier) of a watch sold in the present box may receive a desired price tab ticket with store information as well as model number and price information provided thereon.

23 Claims, 3 Drawing Sheets 101
108
111
4
5
5
110
4
106
115
PRICE
$1.00
150
101
108
111
102
114
6
6
100
104
110
PRICE
$1.00
106
115

WATCH BOX

BACKGROUND OF THE INVENTION

This invention is directed generally to a watch box and, in particular, to a modular watch box with selectively removably information tabs.

While watch boxes are conventionally known for holding watches during transportation, sale and storage, modular watch boxes having selectively releasably coupled information tabs disposed thereon are not known in the art. U.S. Pat. No. 4,773,530 is a prior art packaging container that includes a first upper compartment for holding a watch and a second lower compartment for holding a booklet or pamphlet, such that the booklet or pamphlet is easily securably to the container.

Most companies marketing watches have a plurality of different model watches, and each watch comes in a large size for men and a smaller size for women. The various watches are marketed under different names and model numbers. Furthermore, each watch is sold for a different wholesale and retail price. It is desirable to have the model name and number (feature ticket information) appear on the box, when displayed. Further, it is desirable to have the individual price tag (price tab ticket) displayed on the box. Accordingly, it is desirable to provide a modular watch box having a removable pedestal capable of receiving information tabs thereon and capable of removing at least one of the information tabs without opening the box.

SUMMARY OF THE INVENTION

Generally speaking, in accordance with the present invention, a modular watch box is provided. The watch box includes a base having a watch retention member disposed thereon. At least one information tab holder is also formed on the base. A cover is provided that is selectively coupleable to the base and displaceable between a first position, wherein the cover envelopes at least the retaining member and the tab holder, and a second position, wherein the cover does not envelope the retaining member and the tab holder. The cover defines an opening aligned with the tab holder to selectively allow insertion and removal of a tab from the tab holder.

The box is further provided with a second information tab that is selectively releasably securable to the base and provides an alternative type of information thereon. Preferably, the second tab indicates the make and model of the watch and would be placed on the base when the watch is placed on the watch retention member.

The watch box is also provided with a cover that is selectively removable from the base, such that the base forms a pedestal for displaying the watch thereon. The pedestal includes information tab holders that are used to display the two information tabs. The first information tab (price tab ticket) displays the price information and the second information tab (feature ticket tab) provides the make and model of the watch.

Accordingly, it is an object of the present invention to provide a watch box having a selectively removable information tab disposed on the base of the box.

Another object of the present invention is to provide a modular watch box that includes a slit the cover of the box to allow the information tab to be removed and replaced, or reticketed without opening the box.

Yet another object of the present invention is to provide a modular box that can be customized to the product displayed therein by selectively replacing the feature ticket plate.

Still another object of the invention is to provide one modular watch box that can be customized to each watch produced by a manufacturer, thereby allowing the manufacturer to stock only one box and many different feature ticket tabs.

Still other objects and advantages of the invention will in part be obvious and will in part be apparent from the specification and drawings.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENT

The drawings generally depict a new modular watch box including a releasably securable feature ticket plate and a removable price tab ticket. Specifically, this watch box is designed to form a modular structure, such that the base forms a pedestal for displaying the watch, and the feature ticket is prominently displayed in the front of the base, and the price tab ticket is displayed on the side of 112. the pedestal. A back panel is formed to snap fit to the pedestal and form a backing to highlight a watch when displayed on the pedestal. Furthermore, a front cover is designed to engage the pedestal and back panel to enclose the watch.

Figures 1, 2:
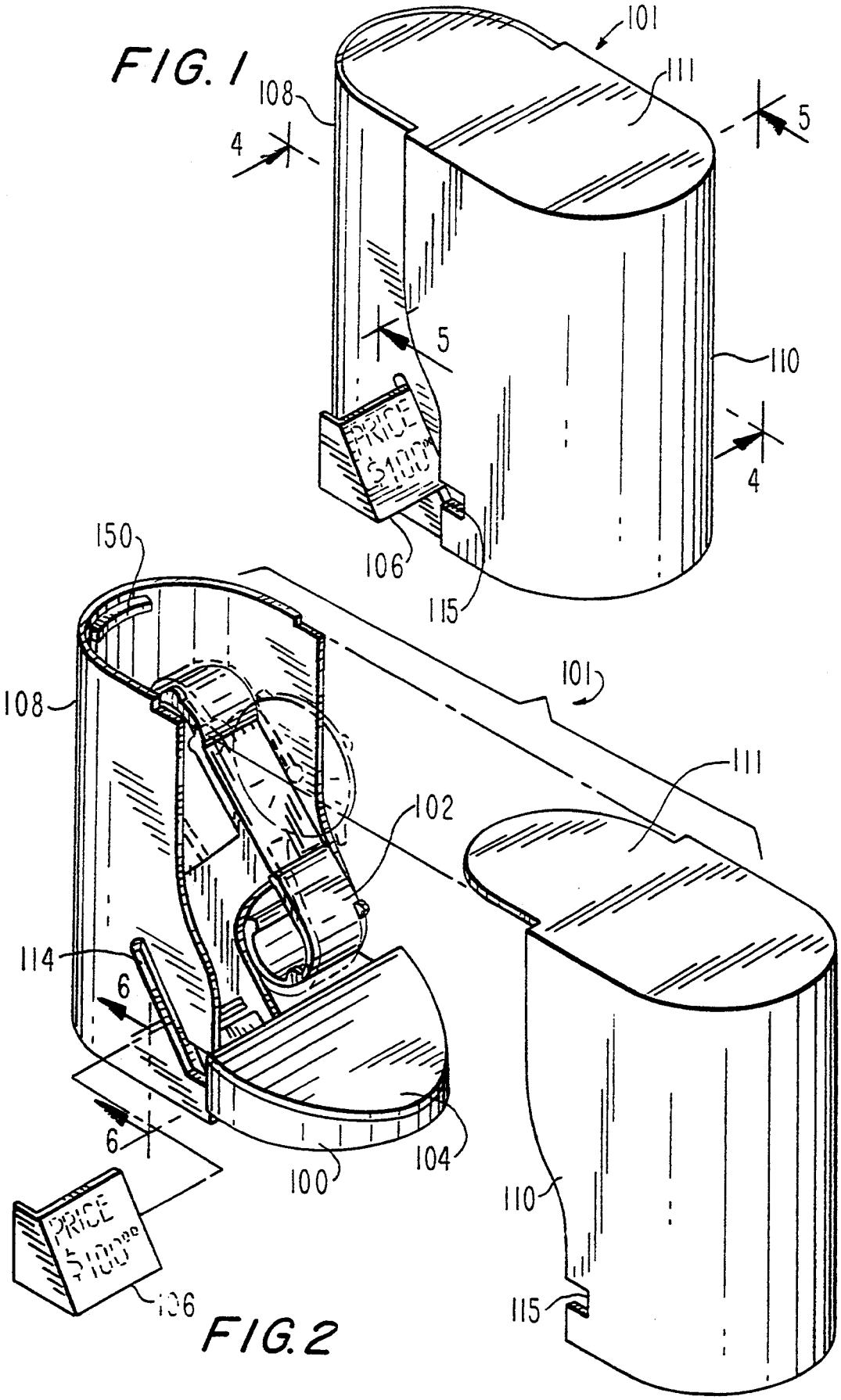
FIG. 1 is a perspective view of a modular watch box, with the price tab ticket displaced from the box opening.
FIG. 2 is a perspective view of the present invention, with the front cover displaced from the base and back panel, and the price tab ticket removed therefrom.
Figure 3:
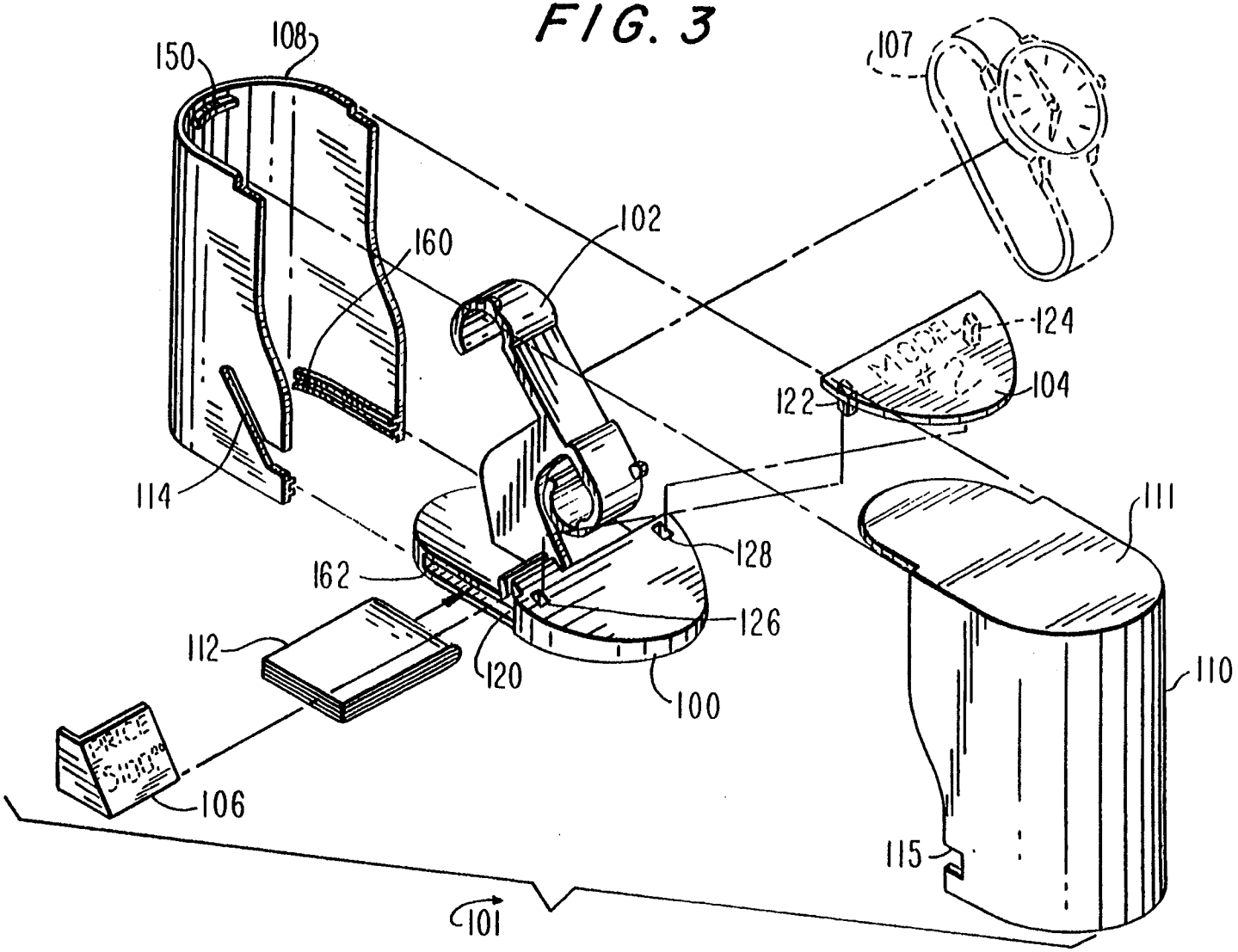
FIG. 3 is an exploded perspective view of the watch box in accordance with the present invention, with a watch shown in phantom.

Reference is now made to FIGS. 1–3, wherein the watch box generally indicated as 101 is depicted in perspective view. Watch box 101 generally includes a base 100 having a watch holder 102 formed integrally therewith. The base is adapted to receive a price tab ticket 106, a feature ticket plate 104 and a pamphlet 112 located in a chamber 120. Base 101 is adapted to snap-fit into back panel 108 and receive front cover 110 to thereby envelope watch holder 102.

The box when closed is generally elliptical in cross section and includes a slit 114 formed in back panel 108 and a cut away portion 115 in front cover 110 to allow price tab ticket 106 to be removed therefrom without removing back panel 108. Pamphlet 112 is received within chamber 120 of base 100. Feature ticket plate 104 includes fingers 122 and 124 that are received within bores 126 and 128 of base 100 to create a snap fit closure between feature ticket plate 104 and base 100.

Figure 4:
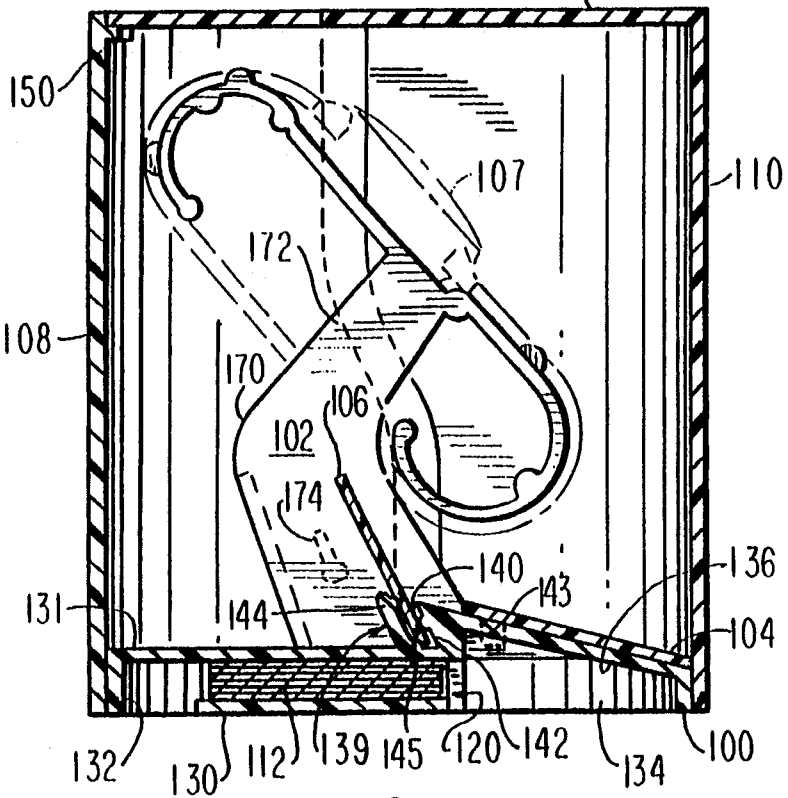
FIG. 4 is a cross-sectional view taken along lines 4—4 of FIG. 1.

Reference is next made to FIG. 4, wherein watch box 101 is shown in cross section. Base 100 includes a flat bottom portion 130 which is aligned in a common plane with the bottom edge of side walls 132 to provide support for watch holder 102. Chamber 120 which includes pamphlet 112 therein is defined by bottom wall 130, top wall 131 and side wall 132. An opening 134 is provided for ingress and egress of pamphlet 112 into and out of chamber 120.

As described above, feature ticket plate 104 is snap-fit on base 100, and in the preferred embodiment is snapped to the front portion of the base 100 on display section 136. Display section 136 is angularly displaced from the common plane of flat bottom portion 130 to provide a preferred viewing angle to one viewing watch 103 (shown in phantom) when front cover 110 is removed.

Price tab ticket 106 is secured within price tab ticket holder, generally indicated at 139. Price tab ticket holder 139 includes a groove 140 defined by ledge 142 which forms the back end of the display wall 136 and retaining wall 144. Retaining wall 144 is formed with a rib 145 and ledge 142 is formed with a rib 143. This configuration allows groove 140 to secure price tab ticket 106 therein. This is due in part to the fact that base 100, back panel 108 and front cover 110 are all formed of plastic materials such as polyvinylchloride, polyethylene, K-Resin or the like. In other words, retaining wall 144 is flexible and resilient and is able to retain price tab ticket 106 in groove 140.

Figure 5:
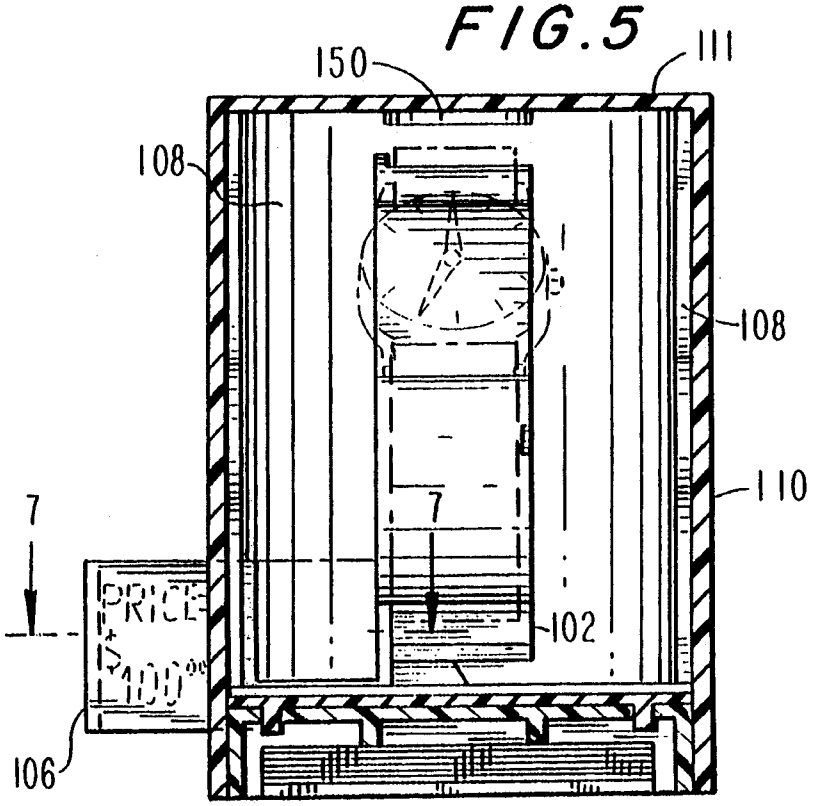
FIG. 5 is a cross-sectional view taken along lines 5—5 of FIG. 1.

With particular reference to FIG. 5, the overlapping arrangement of parts can clearly be seen. Base 100 is snap-fit into back panel 108. Front cover 100 overlaps back panel 108 in order to envelope watch holder 102. Furthermore, at the lower portion of box 101, front cover 110 frictionally engages base 100. Alternatively, at the top of back panel 108 a flange 150 extends into the interior of box 101. Flange 150 is designed to receive top wall 111 of front cover 110 thereon. There is a frictional engagement between top wall 111 and flange 150, as well as flange 150 providing support to top wall 111.

Figure 6:
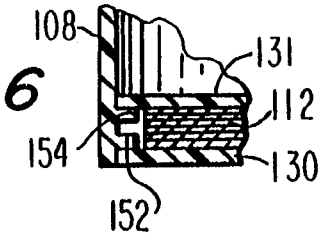
FIG. 6 is a fragmentary cross-sectional view taken along lines 6—6 of FIG. 2.

Particular reference is next made to FIG. wherein a pair of inwardly extending ribs 152 and 154 of back panel 108 are disclosed engaged between top wall 131 and bottom wall 130 of base 100. With particular reference to FIGS. 3 and 6, back panel slidably engages base 100. Furthermore, ribs 152 and 154 of back panel 108 frictionally contact the bottom surface of top wall 131 and the top surface of bottom wall 130 of base 100 to guide back panel 108 into engagement with base 100. Furthermore, back panel 108 snap fits into base 100 when the back portion 160 of ribs 152 and 154 snap over retaining wall 162 of base 100.

Figure 7:
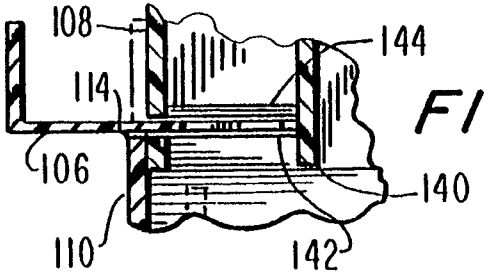
FIG. 7 is a fragmentary cross-sectional view taken along lines 7—7 of the FIG. 5.

With particular reference to FIG. 7, a fragmentary cross-sectional view of the price tab ticket holder 139 of box 101 is disclosed when the box is closed. FIG. 7 illustrates price tab ticket 106 partially within price tab ticket holder 139. Price tab ticket 106 enters box 101 through slit 114 in back panel 108 and through cutaway portion 115 (also shown in FIG. 3) of front cover 110. Price tab ticket 106 is shown partially within groove 140 formed by retaining wall 144 and ledge 142.

From the foregoing description of the elements and the figures it is clearly shown that box 101 is formed as a modular unit which includes a base 100 that is easily snap-fit into back panel 108. It is important that the bottom surface of back panel 108 and the bottom surface of base 100 be formed in a common plane, such that when back panel 108 and base 100 are seated on a common surface, they can slide into one another and snap closed. Furthermore, a feature ticket plate 104 is easily snap-fit into base 100 by fingers 122 and 124 engaging bores 126 and 128. This allows for a single base to be used with multiple different watch models. Furthermore, after the feature ticket plate 104 is installed on the base and the watch 107 is installed on watch holder 102, front cover 110, also including a bottom surface aligned with the bottom surface of base 100 can be slid into engagement at the bottom with base 100 and at the top with back panel 108 including flange 150. Furthermore, at this point, the appropriate pamphlet 112 can be inserted within cavity 120 and price tab ticket 106 can be inserted within groove 140 through slit 114 in back panel 108 and cutaway portion 115 in front cover 110.

In order to further customize this watch box to service a plurality of different watches, watch holder 102 is formed with a stem 170 which is coupled to base 110. Stem 170 includes two protruding fingers 172 and 174 that are provided to engage the watch band to provide a custom tailored fit for multiple different sized watch bands. For instance, a standard female watch band may not engage either protruding fingers 172 or 174 while a large female watch or small male watch may engage protruding finger 172. Alternatively, a standard male watch may engage protruding finger 174.

From the foregoing detailed description, it can clearly be seen that a modular watch box including a base 100 having a watch holder 102, a feature ticket plate 104 attached thereto and a price tab ticket 106 retained within a groove 140 provides a unitary display for a watch. Furthermore, providing a chamber 120 for receiving a pamphlet 112 therein makes this display complete. An optional back panel 108 which is selectively removable allows the display to have a backing if so desired by the user. Further providing this display with a front cover 110 that snap-fits into back cover 108 and base 100 allows this display to be shipped as a single unit.

Accordingly, my invention is not only a unique modular watch box, but a watch display capable of receiving a back panel 108 and front panel 110 to form a shipping box. Furthermore, this shipping box is capable of interchanging price tab tickets 106 without opening the box.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

I claim:

1. A modular watch box comprising a base;
means for retaining a watch on said base;
a tab holder formed on said base; and a cover selectively coupleable to said base and displaceable between a first position, wherein said cover envelopes at least said retaining means and said tab holder and a second position, wherein said cover does not envelope said retaining means and said tab holder;

said cover defining an opening substantially aligned with said tab holder to selectively allow insertion and removal of a first information tab from said tab holder when said cover is secured to said base.

2. The watch box of claim 1, wherein said tab holder is a slot defined by said base.

3. The watch box of claim 2, wherein said opening in said cover is a slit.

4. The watch box of claim 3, wherein said slot is defined by a bearing wall and an essentially parallel retaining wall.

5. The watch box of claim 4, wherein said bearing wall includes at least one rib extending into said slot.

6. The watch box of claim 5, wherein said retaining wall includes at least one rib extending into said slot.

7. The modular watch box of claim 1, wherein said base defines a chamber for receiving a pamphlet therein.

8. The modular watch box of claim 7, wherein said chamber is located at one side of said base and said retaining means is located on a side of said base opposite to said chamber.

9. The watch box of claim 1, further including means for releasably securing a second information tab to said base.

10. The watch box of claim 9, wherein said means for releasably securing includes at least one aperture.

11. The watch box of claim 10, further including a second information tab.

12. The watch box of claim 11, wherein said second information tab includes a flat surface for displaying information thereon and at least one finger extending essentially perpendicular therefrom and adapted to releasably engage said at least one aperture of said mean for releasably securing said second information tab to said base.

13. A modular watch pedestal adapted to releasably engage a cover, comprising:

a platform having a top surface and a bottom surface;

at least one side wall extending from said platform;

a bottom wall coupled to said at least one side wall;

said bottom surface of said platform, said at least one side wall and said bottom wall defining a compartment;

means for holding a watch coupled to said top surface of said platform; and first indicating means selectively releasably coupled to said top surface of said platform.

14. The modular watch pedestal of claim 13, wherein said platform includes a slot defined by a bearing wall and an essentially parallel retaining wall for releasably securing said first indicating means to said platform.

15. The modular watch pedestal of claim 13, including a second information tab releasably coupled to said top surface of said platform.

16. The modular watch pedestal of claim 15, wherein said second information tab includes a flat surface for displaying information thereon and at least one finger extending essentially perpendicular therefrom.

17. The modular watch pedestal of claim 16, wherein said pedestal includes means for releasably securing said second information tab to said platform.

18. The modular watch pedestal of claim 17, wherein said means for releasably securing includes at least one aperture for receiving said at least on finger thereon.

19. The modular watch pedestal of claim 13, wherein said second information tab includes a flat surface for displaying information thereon and at least one finger extending essentially perpendicular therefrom and adapted to releasably engage said at least one aperture of said mean for releasably securing said second information tab to said base.

20. The modular watch pedestal of claim 19, further including a cover having a back panel and a front panel.

21. The modular watch pedestal of claim 20, wherein said front panel frictionally engages said back panel and said pedestal to be releasably secured thereto.

22. A method of assembling a modular watch box including a base, a back panel and a front panel, wherein said base includes a top wall, a bottom wall and a side wall extending between a portion of the top wall and bottom wall thereby defining a space therebetween where said side wall does not extend between said top wall and said bottom wall, and said method comprising the steps of:

providing said back panel with at least one rib having a first end and a second end said rib extending in an axial direction, such that it is aligned with said space in said base;

displacing said back panel against said base such that one of said first end and said second end of said at least one rib bears against said side wall of said base; and displacing said front panel into frictional engagement with at least one of said back panel and said base.

23. A method of replacing an information tab from within a watch box without opening the watch box, wherein the watch box includes a base including an information tab holder and a watch box cover including a slit, the method comprising the steps of:

providing the slit in the cover in alignment with the information tab holder of the base;

removing a first information tab from said information tab holder by sliding same through said slit; and sliding a second information tab through said slit and into said information tab holder.

* * * * *